United States Patent [19]

Savage

[11] Patent Number: 4,524,826

[45] Date of Patent: Jun. 25, 1985

[54] METHOD OF HEATING AN OIL SHALE FORMATION

[75] Inventor: Kerry D. Savage, Houston, Tex.

[73] Assignee: Texaco Inc., White Plains, N.Y.

[21] Appl. No.: 387,996

[22] Filed: Jun. 14, 1982

[51] Int. Cl.[3] ..... E21B 43/00

[52] U.S. Cl. ..... 166/248; 166/60; 166/263

[58] Field of Search ..... 166/248, 60, 263, 245

[56] References Cited

U.S. PATENT DOCUMENTS

| | | | |
|---|---|---|---|
| 4,144,935 | 3/1979 | Bridges et al. | 166/248 |
| 4,196,329 | 4/1980 | Rowland et al. | 166/248 |
| 4,301,865 | 11/1981 | Kasevich et al. | 166/248 |

*Primary Examiner*—James A. Leppink

*Assistant Examiner*—Michael A. Goodwin

*Attorney, Agent, or Firm*—Robert A. Kulason; Ronald G. Gillespie

[57] ABSTRACT

A method of heating an oil shale formation to produce shale oil includes radiating RF energy into the oil shale formation for a predetermined first time interval from a first borehole which penetrates said oil shale formation. Shale oil is produced when available during said first time interval from a second borehole penetrating said oil shale formation which is a predetermined distance from the first borehole. During a predetermined second time interval, RF energy is again radiated into the oil shale formation from the second borehole while shale oil is produced from the first borehole during the second time interval.

5 Claims, 5 Drawing Figures

METHOD OF HEATING AN OIL SHALE FORMATION

BACKGROUND OF THE INVENTION

Description of the Invention

The present invention relates to the method for obtaining hydrocarbons from an earth formation and, more particularly, obtaining shale oil from an oil shale formation.

SUMMARY OF THE INVENTION

A method of heating an oil shale formation to produce shale oil includes radiating RF energy into the oil shale formation during a predetermined first timed interval from one borehole which penetrates the oil shale formation. Shale oil, when available, is produced during the first time interval from another borehole penetrating the oil shale formation a predetermined distance from the one borehole. In a predetermined second time interval, RF energy is radiated into the oil shale formation from the other borehole while shale oil is produced from the first borehole.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

The dwindling petroleum supplies have necessitated the acquisition of petroleum from sources other than conventional crude oil reservoirs. One source is oil shale in which there have been several patents disposed towards the utilization of electromagnetic energy at a radio frequency for heating the formation to a temperature sufficient to convert the kerogen into hydrocarbon fluids. The electromagnetic energy at the radio frequency shall hereinafter be referred to as RF energy. Some of those patents are U.S. Pat. Nos. 4,140,179; 4,140,180; 4,144,935 and 4,193,451.

Figure 1:
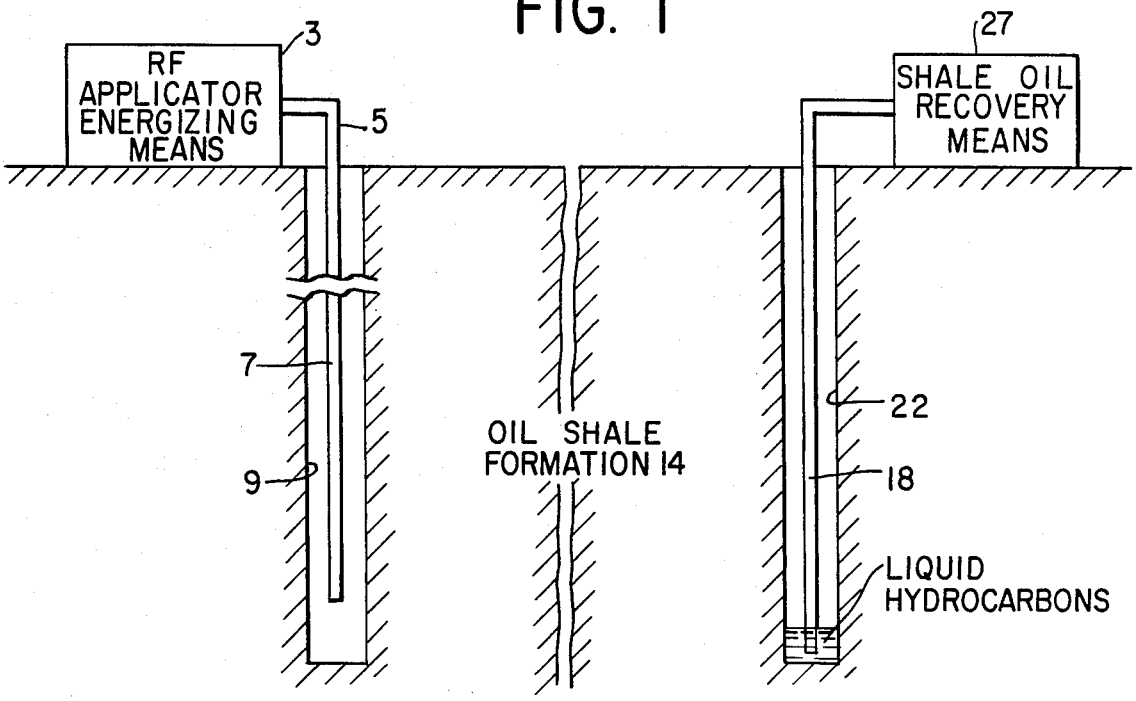
FIG. 1 is a representation of a conventional type oil shale recovery operation using RF energy.

With reference to FIG. 1, a simplified explanation of RF retorting of oil shale requires RF applicator energizing means 3 which provides the RF energy by way of a conduit 5 to an applicator 7 in a borehole 9. Applicator 7 radiates the RF energy into an oil shale formation 14 for a period of time sufficient to raise the temperature in oil shale formation 14. At a high temperature, the kerogen contained in the oil shale is converted to fluid hydrocarbons. Recovery apparatus 18 in another borehole 22 brings the hydrocarbon to the surface to shale oil recovery means 27. Obviously gaseous hydrocarbons also result from the conversion of the kerogen. The gaseous hydrocarbons may also be produced or flared as desired.

Figure 2:
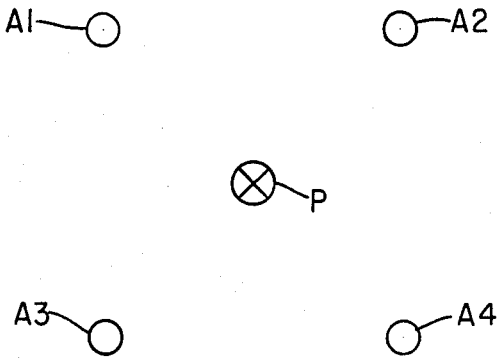
FIG. 2 is a layout diagram of boreholes in a proposed type shale oil recovery method.

Utilization of the aforementioned patents envision a grid of well patterns, one pattern of which is shown in FIG. 2 in which there are four wells identified as A1, A2, A3 and A4 in which RF applicators are inserted and energized to produce the hydrocarbon fluids at well P, although some hydrocarbons may be produced at the applicator wells. The lateral temperature profile in the oil shale of such an arrangement will show sharp peaks in temperature near the applicator borehole walls of A1, A2, A3 and A4 (See FIG. 2). The lateral temperature profile near the center area of this "5-spot" pattern, i.e. in a large region near the P well, will be broad and flat. The temperature level near the P well may be as high or higher than that at the applicator wells. This well pattern would be used in a grid throughout a large area of the oil shale to be retorted.

The present invention concerns itself with a novel approach to the use of applicator wells and producing wells to improve upon the temperature distribution and the ratio of producing wells to applicator wells. The present invention will allow the reduction of holes per unit area without sacrificing temperature uniformity, or will improve uniformity with the same number of wells.

Figure 3A:
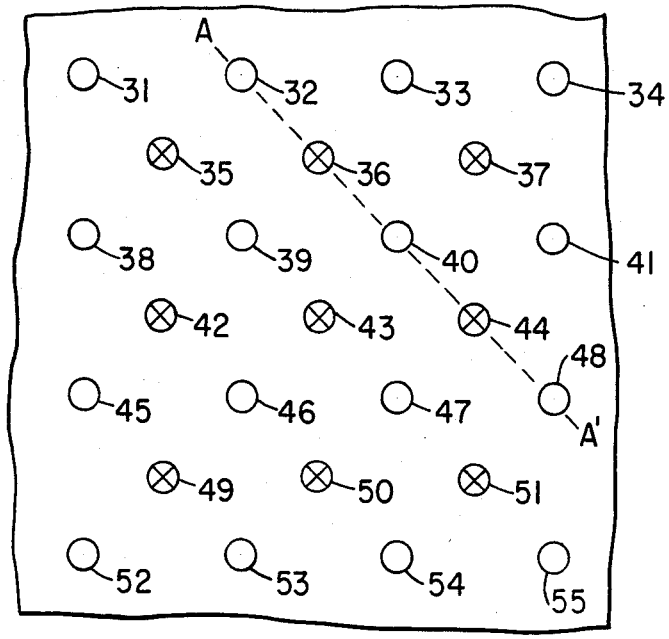
FIGS. 3A and 3B are layout diagrams of boreholes during different time intervals in the shale oil recovery method of the present invention.

Referring now to FIG. 3A, there are shown wells 31 through 55 in which each well is constructed in the same manner. In FIG. 3A those wells that are represented with circles, namely wells 31 through 34, 38 and 41,45 through 48 and 52 to 55, are operated as applicator wells for a predetermined time interval, while those wells that are represented with circles having crosses in them, namely wells 35, 36, 37, 42, 43, 44, 49, 50 and 51, are producing wells.

Figure 4:
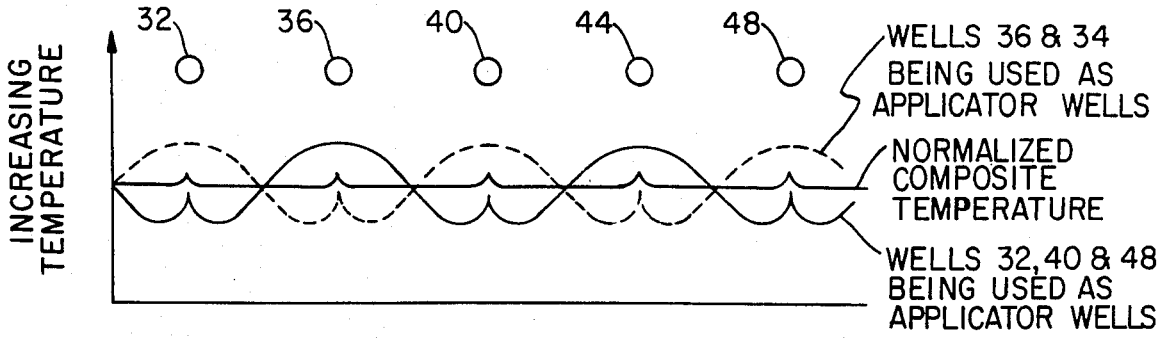
FIG. 4 is a graphical representation of heat distribution in the oil shale formation along line A—A′ shown in FIGS. 3A and 3B.
Figure 3B:
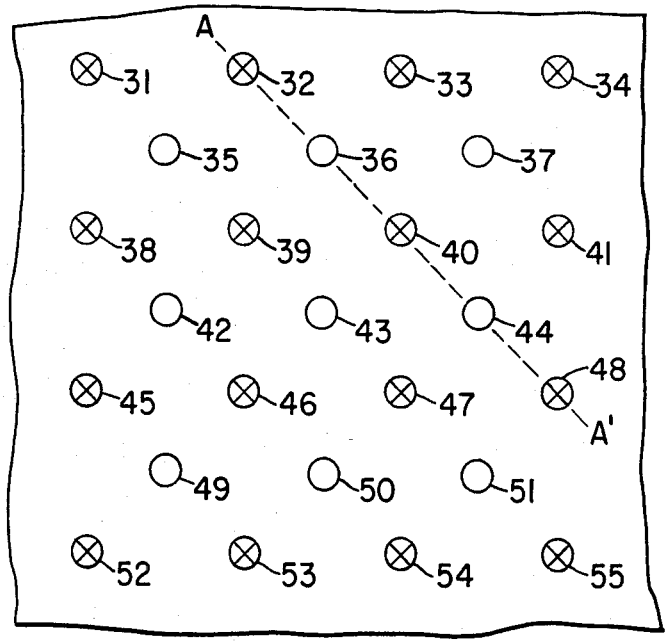

After a lapse of the time interval, wells 1 through 34, 38 through 41, 45 through 48, and 52 through 55 are operated as producing wells as shown in FIG. 3B, while wells 35, 36, 37, 42, 43, 44, 49, 50 and 51 are operated as applicator wells. Additional time intervals may be used with the wells having their functions reversed every time the intervals change. The alternate operation of a well first as an applicator well then as a producing well, then back as an applicator well, causes the heating of oil shale formation 14 to be more evenly distributed between the wells as can be seen in FIG. 4 which is a temperature profile of the formation 14 along line A—A′. The solid line indicates the utilization of wells 32, 40 and 48 as applicator wells and wells 36 and 44 as producing wells, while the dashed line indicates the utilization of wells 36 and 44 as applicator wells and wells 32, 40 and 48 as producing wells. With the alternation of the use of a well as an applicator well and then as a producing well causes the heat distribution in the formation to assume a distribution along line A—A′ as shown by the curve in FIG. 4, as against the other two distributions shown if only either set of wells is powered.

The distance between wells and the length of time for "cycling" is designed as a function of the power applied to each applicator in an applicator well and the frequency of the RF power. The lower the power and/or the higher the frequency, the shorter the distance between wells. The greater the power and/or the lower the frequency the greater distance between wells. Ordinarily, each well would have its own applicator in place. However, due to economics it may be more desirable to remove an applicator from an applicator well and physically transport it to the new applicator well. Generally speaking it may be preferred to have the cycling as one tenth of the retort time for the oil shale. That is, for example, if the complete retort time is said to be one year then approximately every thirty-six days the wells will alternate their functions.

The present invention as hereinbefore described is a method of heating an oil shale formation with RF energy to produce fluid hydrocarbons from the conversion of kerogen so as to minimize the number of wells required and/or to produce a more uniform temperature distribution between wells in the formation to be heated.

What is claimed is:

1. A method of heating an oil shale formation to produce fluid hydrocarbons comprising radiating RF electromagnetic energy into the oil shale formation for a predetermined first time interval from a first borehole which penetrates said oil shale formation, producing fluid hydrocarbons, when available, during said first time interval from a second borehole penetrating said oil shale formation a predetermined distance from said first borehole, radiating RF electromagnetic energy into said oil shale formation during a predetermined second time interval from said second borehole, producing fluid hydrocarbons during said second time interval from said first borehole.

2. A method as described in claim 1 further comprising additional time intervals in which each borehole in said oil shale formation is alternately used to radiate RF electromagnetic energy into said oil shale formation during every other time interval and producing shale oil in the time intervals when the borehole is not used for RF radiation.

3. A method of heating an oil shale formation having a plurality of boreholes traversing said shale oil formation for producing shale oil comprising radiating RF energy into the oil shale formation from a predetermined first group of boreholes during a first time interval, producing shale oil, when available, in a second group of boreholes, where the boreholes of the second group are alternately interspersed between the boreholes of the first group of boreholes, radiating RF energy into the oil shale formation during a predetermined second time interval from boreholes in the second group of boreholes, and producing fluid hydrocarbons during said second time interval from boreholes in the second group of boreholes.

4. A method as described in claim 3 further comprising additional time intervals in which the oil shale formation will be subjected to RF radiation from within boreholes in the first group of boreholes every other time interval and producing fluid hydrocarbons in the intervening time intervals and the oil shale formation is subjected to RF radiation from boreholes in the second group of boreholes when the first group of boreholes are producing shale oil in the time intervals that the first group of boreholes are being used to radiate the oil shale formation with RF energy.

5. A method of heating an oil shale formation having a plurality of boreholes traversing said formation to produce shale oil comprising radiating the oil shale formation with RF energy from within each borehole of a first group of boreholes during a first group of time intervals and producing shale oil in the boreholes of the first group of boreholes during a second group of time intervals, said time intervals of the first group and the second group are alternately interspersed with each other, radiating the shale oil formation with RF energy from within a second group of boreholes during time intervals in said second group of time intervals, and producing shale oil from said oil shale formation during the time intervals of said first group of time intervals.

* * * * *